US006024468A

United States Patent [19]

Kassay et al.

[11] Patent Number: 6,024,468

[45] Date of Patent: Feb. 15, 2000

[54] HIGH LUMEN OUTPUT FLUORESCENT LAMP DOWN LIGHT FIXTURE

[76] Inventors: Charles Kassay; Suzanne Kassay; J. Peter Kassay; Marc Kassay, all of 9 Long Hill Rd., Smithtown, N.Y. 11787

[21] Appl. No.: 08/896,363

[22] Filed: Jul. 18, 1997

[51] Int. Cl.[7] ..... F21S 3/02

[52] U.S. Cl. ..... 362/260; 362/217; 362/225

[58] Field of Search ..... 362/217, 225, 362/260, 297

[56] References Cited

U.S. PATENT DOCUMENTS

| | | | |
|---|---|---|---|
| 4,520,436 | 5/1985 | McNair et al. | 362/366 |
| 4,704,664 | 11/1987 | McNair | 362/225 |
| 4,779,178 | 10/1988 | Spitz | 362/260 |
| 4,922,393 | 5/1990 | Mcnair | 362/225 |
| 4,947,297 | 8/1990 | Druffel et al. | 362/217 |
| 5,197,798 | 3/1993 | Tickner | 362/235 |
| 5,197,799 | 3/1993 | Tickner | 362/420 |
| 5,207,504 | 5/1993 | Swift et al. | 362/217 |
| 5,343,373 | 8/1994 | Tillotson | 362/260 |
| 5,377,086 | 12/1994 | Tickner | 362/260 |
| 5,434,762 | 7/1995 | Shemitz | 362/260 |
| 5,473,522 | 12/1995 | Kriz et al. | 362/260 |
| 5,523,931 | 6/1996 | Kassay et al. | 362/235 |
| 5,528,473 | 6/1996 | Kassay et al. | 362/247 |
| 5,555,162 | 9/1996 | Shemitz | 362/260 |
| 5,584,575 | 12/1996 | Fickel | 362/260 |
| 5,727,871 | 3/1998 | Kotloff | 362/260 |

OTHER PUBLICATIONS

Luminaire Testing Laboratory, 905 Harrison Street Allentown, PA 18103, Report #01481, dated Feb. 24, 1994.

Tupper Lighting Applications, POB 794, Baldwinville, NY 13027, Maxi–9 Analysis, dated Mar. 8, 1994.

*Primary Examiner*—Laura K. Tso

*Attorney, Agent, or Firm*—Alfred M. Walker

[57] ABSTRACT

An alternative lighting system luminaire to conventional high intensity discharge light fixtures such as mercury vapor, metal halide, high pressure sodium lighting fixtures includes a highly polished reflector made of silver film or highly polished aluminum with a plurality of fluorescent biax lamps to provide both greater lumen production per watt and retain a greater percentage of it's lumen output over the fixtures life. This system allows one for one fixture replacement when substituted for 400-watt metal halide, 400 watt high pressure sodium, and 400–1000 watt mercury vapor high intensity discharge lighting fixtures in design or replacement applications. The luminaire utilizes very high efficiency "Dulux L" high lumen compact fluorescent lamps, which are each shaped like a single inverted "U" and are a minimum of 16 inches long. The lamps extend parallel to the face lens of the fixture and can number from one to eight in quantity. A highly polished reflector is placed above the lamps allowing for the maximum amount of light to be emitted from the face of the fixture with the lens. The lamps are secured and powered by sockets fastened to plates, which are mounted at two opposing sides of the fixture. Ballasts are located in the area between the reflector and the top of the fixture. The upper section of the fixture is angled upward to create a pyramid effect that gives stability to the fixture when it is pendant hung from a ceiling.

13 Claims, 8 Drawing Sheets

HIGH LUMEN OUTPUT FLUORESCENT LAMP DOWN LIGHT FIXTURE

FIELD OF THE INVENTION

The present invention relates to a lighting fixture which more efficiently produces lumens for large volume lighting environments.

BACKGROUND OF THE INVENTION

There are many typical uses for high intensity discharge (H.I.D.) lighting fixtures, such as for retail stores, warehouses, commercial buildings and other uses possessing relatively high ceilings. H.I.D. lighting fixtures have been highly successful due to their extreme amount of output of light. Sources of H.I.D. lighting are mercury vapor, metal halide and high pressure sodium.

These H.I.D. fixtures typically include a single light source lamp with a solid reflector utilized to direct the light in a downward direction. This reflector is normally a bell shape or conical shape. These prior art reflectors are made of reflective substances such as polished aluminum to enhance the efficiency of the fixture. The single lamp supplies direct light and light reflected off the reflector in a downward direction.

The great quantity of light supplied by these prior art H.I.D. fixtures, combined with atypical 1.5 to 1.7 light coverage criteria, wherein the light coverage is 1.5 to 1.7 times the open area of the fixture, allows for a greater light coverage area with fewer fixtures.

The drawbacks to using these prior art H.I.D. light sources are the use of excessive amounts of energy, poor color rendition, diminishing lumen output over the life of the lamp, no choice of color temperatures and a lack of high efficiency electronic ballasts to power the H.I.D. light sources.

An alternative prior art source of light has been fluorescent lamped fixtures. These fluorescent lamped fixtures have typically utilized long longitudinally extending cylindrical lamps, which are mounted at or slightly below the ceiling level, parallel to the floor surface. These prior art fluorescent lamp fixtures are usually one (1) to four (4) tubes of four foot to eight foot lengths per fixture, and these prior art fixtures utilize much lower wattage per fixture than the prior art H.I.D. light fixture. The fluorescent lamped fixtures illuminate a rectangular area and they are usually placed in rows mounted end to end. The draw back with the prior art fluorescent fixtures is the large quantity of lamp fixtures required and the lack of efficiency. The large quantities of prior art fluorescent fixtures significantly increases the initial installation costs, with no advantage or savings because of the increased labor cost, when compared to the installation of prior art H.I.D. light fixtures. The traditional fluorescent lamp also lacks the intensity needed for large spacing between lamps at high mounting levels.

New technology has brought about the compact fluorescent lamp, which is a four-prong lamp with two sets of joined ends creating a double inverted U effect relative to the base. The normal wattage for these double U-shaped fluorescent lamps is from 5 to 26 wattage per lamp. The biax fluorescent is another new technology utilizing a single elongated narrow "U" effect relative to the base. The normal wattage for these biax lamps is from twenty six (26) to fifty five (55) watts.

There have been several prior art patents utilizing these double U-shaped fluorescent lamps and socket combinations. Among the prior art patents are U.S. Pat. Nos. 4,520,436, 4,704,664 and 4,922,393, all of NcNair, U.S. Pat. No. 5,197,798 of Tickner and, additionally, U.S. Pat. Nos. 5,523,931 and 5,528,473 for high output fluorescent lighting fixtures, both of the Applicants Charles E. Kassay, J. Peter Kassay and Marc A. Kassay. McNair '436, McNair '664 and McNair '393 all describe light fixtures, which utilize only a pair of these small compact lamps, generally 3.4 inches to 7.6 inches in length. The double U-shaped lamps of McNair '436, McNair '664 and McNair '393 are mounted so as to be askew to each other in a reflector, which allows light out one end in quantities enough to replace small incandescent lamps (such as 50 W–100 W) in similar incandescent fixture configurations. The reflectors in McNair '436, McNair '664 and McNair '393 are also designed with openings in their respective upper sides to allow for the mounting of the socket, and connection of these sockets to the ballasts, which power the double U-shaped fluorescent lamps from outside the confines of the reflector. The complete light fixture packages of McNair '436, McNair '664 and McNair '393 are further encased in larger housings to enclose the wiring, ballasts, and sockets.

The usefulness of these fixtures of McNair '436, McNair '664 and McNair '393 over conventional incandescent fixtures is that the fixtures of McNair '436, McNair '664 and McNair '393 can replace higher wattage incandescent fixtures with a high percentage reduction of energy usage. Moreover, the lamp life of the double U-shaped fluorescent lamps utilized therein is longer than incandescent lamps of which the lamps of McNair '436, McNair '664 and McNair '393 can replace.

Another related prior art patent is that of Tickner, '798 wherein a light fixture utilizes a grouping of 26 watt compact fluorescent "Dulux D" double U-shaped lamps, with either six (6) lamps, eight (8) lamps, or twelve (12) lamps per fixture. Single or pairs of lamps are activated by individual ballasts. The lamps in Tickner '798 are mounted in a solid, non-translucent reflector so as to direct all light in a downward direction. The socket mounting plates in Tickner '798 are mounted within the concave reflector from ¼ to ½ of the distance from the narrow base opening of the reflector to the wider light emitting output portion of the reflector. By combining this large number of 26 watt compact double U-shaped fluorescent lamps the fixture of Tickner '798 can produce as many as 14,400 initial lumens in an eight light configuration and 21,600 lumens in a twelve lamp configuration. These wattages produced by the device of Tickner '798 compare evenly with that of a 250 watt metal halide high intensity discharge lamp or a 200 watt high pressure sodium lamp. However, this low wattage compact fluorescent light fixture of Tickner '798 produces only approximately 69 lumens per watt, which is a significant drawback. The fixture of Tickner '798 at it's maximum potential cannot come near the very popular 400 watt metal halide H.I.D. high intensity discharge lamps for production of lumens, which initially produces 36,000 lumens, with a mean of 29,000 lumens.

OBJECTS OF THE INVENTION

To overcome the disadvantages and drawbacks of the prior art patents, it is a desirable object of the present invention to produce a fixture producing higher quantities of light as to allow for the "one for one" replacement of the greater wattage of high intensity discharge (H.I.D.) light fixtures.

It is a further object of the present invention to show greater lumen production per watt and a greater efficiency produced by the fixture itself.

It is yet another object of the present invention to provide an efficient structural configuration for the housing of a fluorescent lamp fixture which maximizes lumen output.

It is yet another object to produce wide variation of light outputs to solve a multitude of lighting problems with a uniform design and mounting criteria.

To improve over the disadvantages of the prior art, it is another object of the present invention to create a superior lighting fixture, not only a different one.

It is also a further object of the present invention to utilize the most efficient fluorescent lamp available and to produce the highest efficiency combination of lamp locations, of electronic ballasts, and of reflectors and/or refractors.

It is yet another object of the present invention to allow for the pre-selected control of predetermined set of lamps individually controlled to create lower light levels when required and to extend the intervals between changing of lamps.

SUMMARY OF THE INVENTION

In keeping with these objects and others which will become apparent, the present invention includes a luminaire lighting fixture which contains a reflector and/or a refractor, a plurality of multi lamp "Dulux L" single U-shaped compact fluorescent lamps, such as, preferably, lamps which have a Philips designation or equal under industry standards. The present invention includes a plurality of configuration sockets such as 2G11, 2G7, 2GX7, preferably Sylvania designation or equal, a socket plate or set of plates holding the sockets, a ballast enclosure or cavity housing holding one or more ballasts and wherein the reflector or reflectors are provided and which housing has an ability to receive a bottom light transmitting lens.

The shape of the housing of the present invention allows for pendant, stem or chain mounting as is the standard mounting for high bay/low bay high intensity discharge fixtures.

A socket plate or pair of socket plates are mounted in the fixture, at the side of the fixture, at the base end of the fixture, to allow for a plurality of lamps and the inclusion of a reflector or plurality of reflectors.

A plurality of U-shaped fluorescent lamps are provided, such as "Dulux L" of Philips designation or equal, which lamps are compact fluorescent lamps in quantities from two to twelve lamps per fixture. The lumens generated from such a configuration of lamps ranges from 6,300 to 57,600 lumens.

The single U-shaped fluorescent lamps, such as "Dulux L" lamps, receive their power from ballasts mounted in the ballast cavity, which is above the reflector in the fixture. In a multi-ballast configuration the fixture has the ability to achieve multiple light levels through independent switching of the ballasts via line voltage switches or a low voltage relay system, which can be incorporated within the fixture.

DESCRIPTION OF THE DRAWINGS

The present invention can best be understood in connection with the accompanying drawings, in which.

DETAILED DESCRIPTION OF THE DRAWINGS

Figure 1:
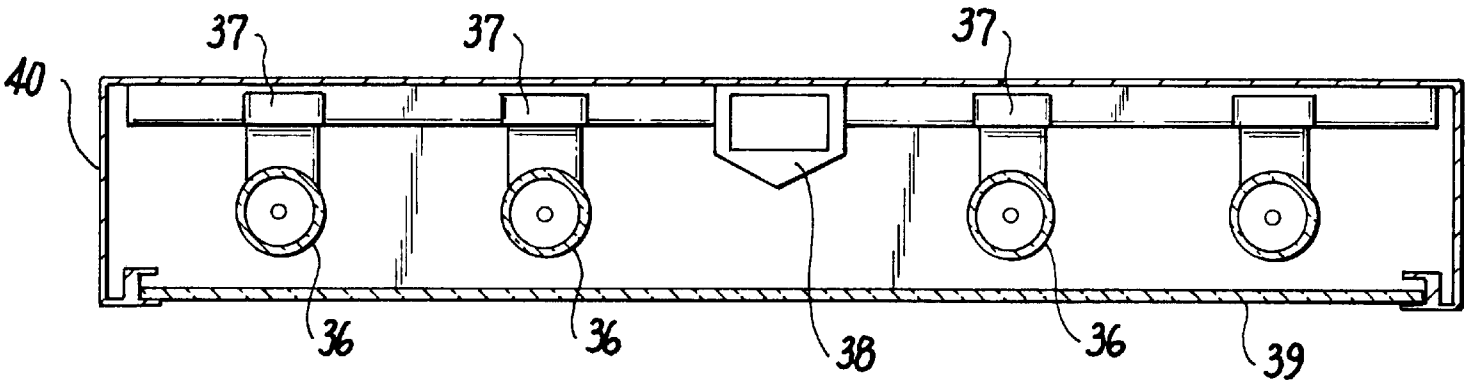
Fig. 1 (Prior Art)
FIG. 1 is a side elevational end view in cross section of a prior art surface mount fluorescent lamp fixture.

Referring to FIG. 1, designated "Prior Art", there is a shown cross sectional diagram of a typical surface mount fluorescent lighting fixture. Fluorescent fixtures have linearly extending cylindrical lamps (36) clipped into electrical sockets (37) to receive electrical power from ballast (38), to obtain increased voltages to energize the gases in each respective fluorescent lamp (36). The light produced by these prior art fixtures is emitted in a downward direction out an open light emitting end through lens (39). A great deal of the light generated is not emitted, as it is not reflected efficiently, because of the low reflectivity of the inside of rectilinear box-like housing (40).

Figure 1A:
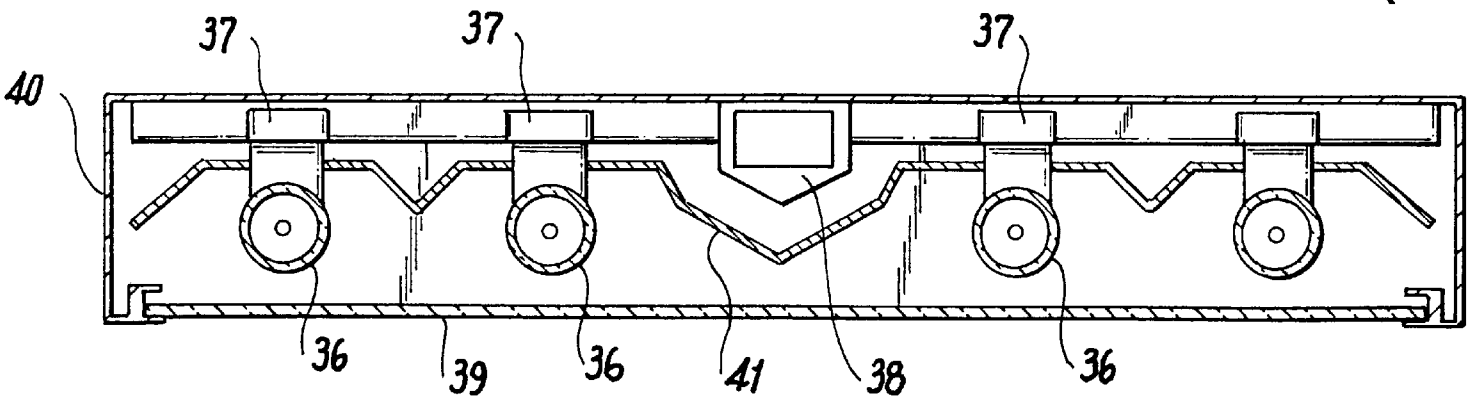
Fig. 1A (Prior Art)
FIG. 1A is a side elevational end view in cross section of the fluorescent lamp fixture of FIG. 1, shown with a reflector added.

Referring to FIG. 1A, these prior art fluorescent fixtures have recently been enhanced by the use of reflectors (41) to increase the amount of light emitted. The amount of lumens generated by these prior art fixture with four lamps is about 5,100 lumens and with six lamps the output is about 7,650 lumens.

These prior art fluorescent fixtures of FIGS. 1 and 1A are used in commercial buildings, retail applications and other locations having relatively low ceilings and requiring that they be installed closely together. A chief disadvantage of these prior art fluorescent fixtures is that they cannot be utilized in areas with high ceilings due to the low lumen output therefrom and difficulty in mounting.

Figure 1B:
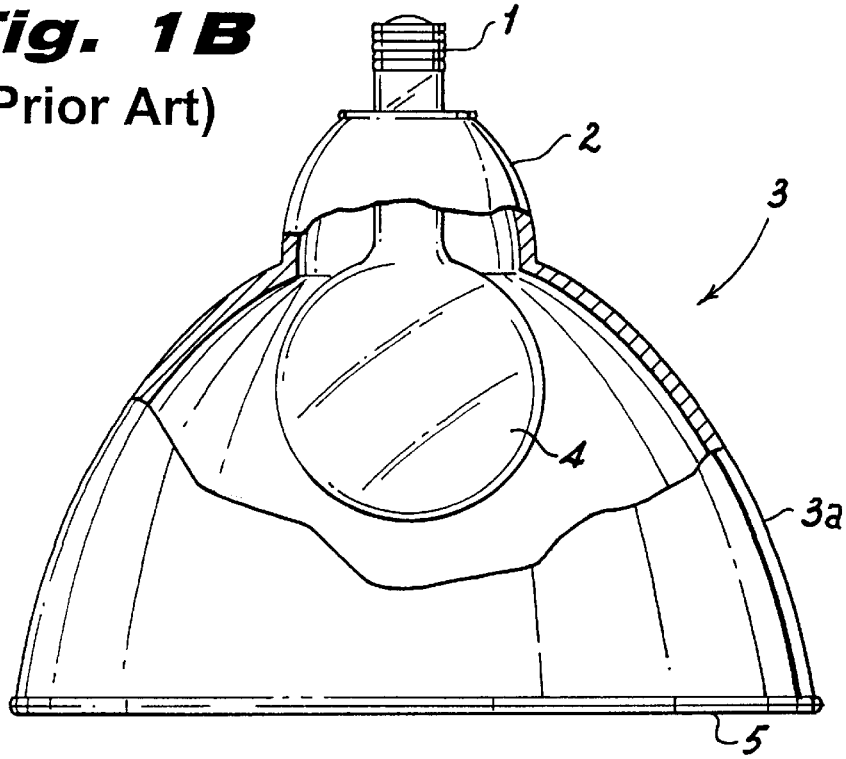
Fig. 1B (Prior Art)
FIGS. 1B, 1C and 1D show side elevational views in partial cross section of various prior art high intensity discharge lamp fixtures.

Referring to FIG. 1B, also designated "Prior Art", there is shown a cross sectional diagram of a typical high intensity discharge (H.I.D.) fixture. H.I.D. fixture units (3) have a large screw in base (1), which base (1) is screwed into a conventional socket, to receive electrical power from a ballast, to obtain increased voltages and to energize the gases in the H.I.D. lamp (4). The light produced by these H.I.D. prior art fixtures is totally directed by a concave reflector (3) in a downward direction, out an open light emitting end (5) of the high intensity discharge lighting fixture. The base end in which the lamp (4) is mounted is noted by reference numeral (2).

These high intensity discharge lighting fixtures as previously stated are primarily used in warehouses, commercial building, and other locations having relatively high ceilings. High intensity discharge lighting fixtures (H.I.D.'s ) most commonly use 250 watt, 400 watt, and 1000 watt mercury vapor, metal halide, or high pressure sodium lamps. The light from a high intensity discharge (H.I.D.) lighting fixture (3) can be dispersed by means of a lens attached to the rim at the open end or at light emitting end (5).

Figure 1C:
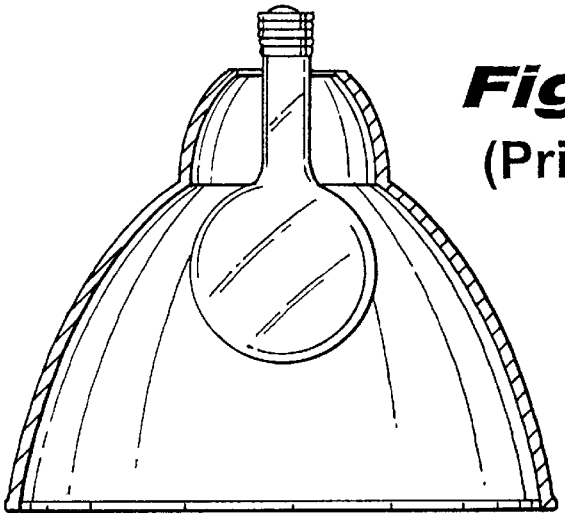
Fig. 1C (Prior Art)
Figure 1D:
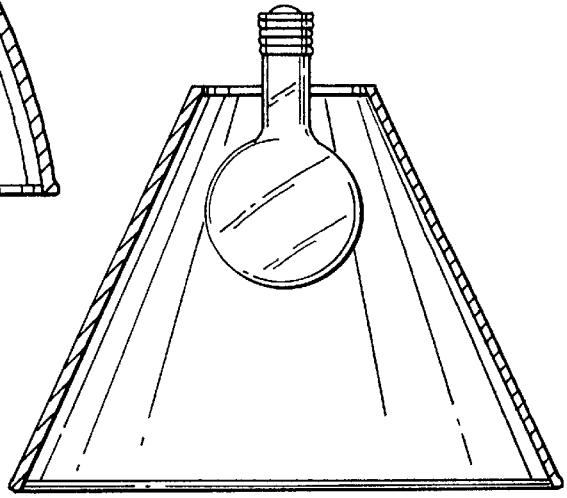
Fig. 1D (Prior Art)

FIGS. 1C and 1D show in partial cross-section two typical cross sectional shapes of prior art high intensity discharge (H.I.D.) reflectors.

Figure 1E:
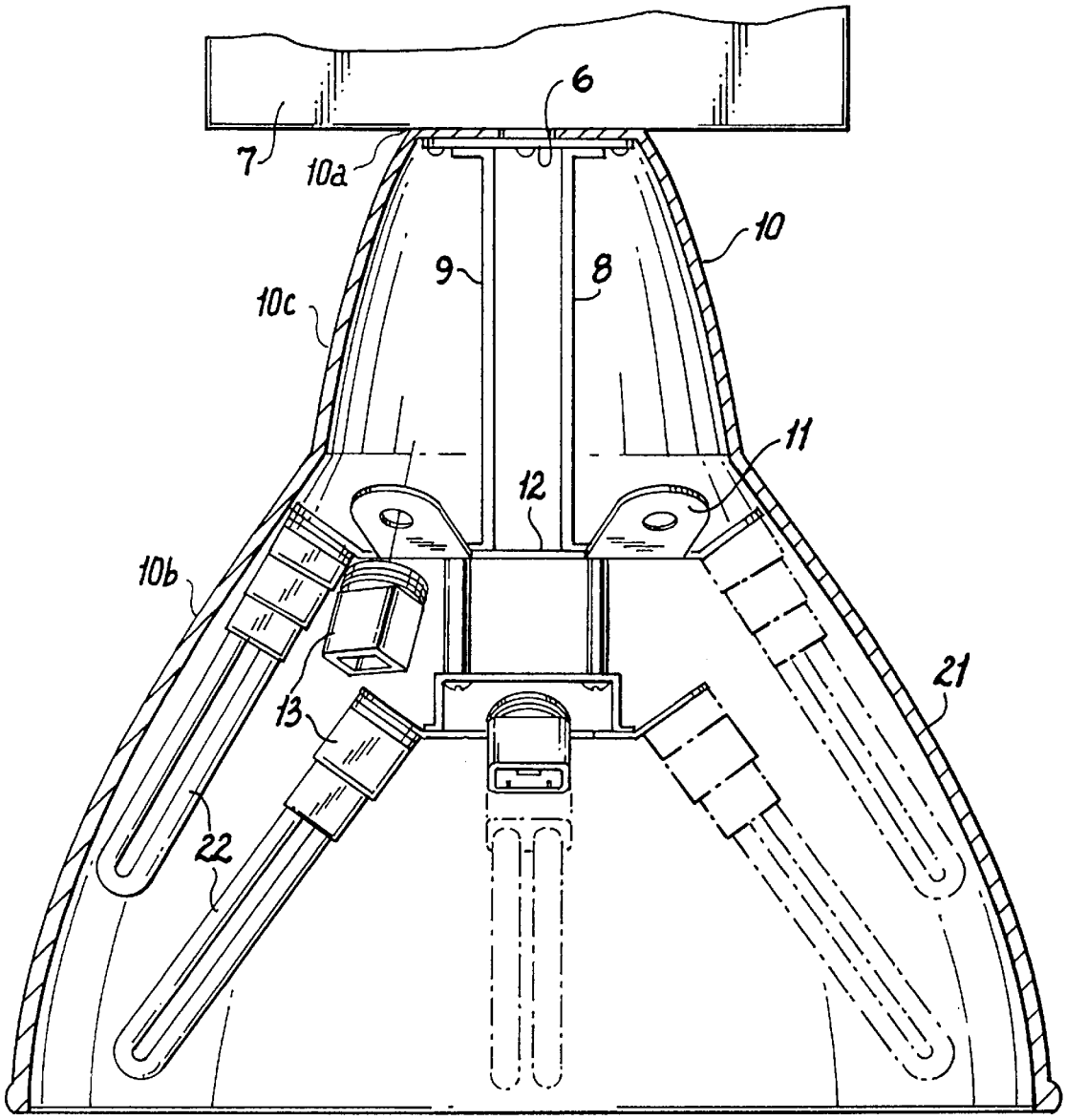
Fig. 1E (Prior Art)
FIG. 1E is a side elevational view in cross section of a prior art compact fluorescent lamp fixture.

FIG. 1E is a diagram of a side elevational view in cross section of the prior art of U.S. Pat. No. 5,197,799 of Tickner, which shows a compact fluorescent fixture (10) with lower hemisphere reflector (10*b*) and upper hemisphere (10*c*) ballast enclosure (7) attached above securing plate (6) at a base end 10*a* thereof. Attached to plate (6) is also a socket mounting assembly including leg braces (8) (a), holding downward therefrom socket extension tabs (11) emanating from support plate (12). Each socket (13) is fastened to each of the socket extension tabs (11). Socket plate (12) includes six or eight sides to receive six or eight double U-shaped fluorescent lamps. Tickner '798 also describes additional optional provisions to receive four lower intermediate lamps to create a twelve lamp fixture. The wires in the Tickner '798 light fixture connect to the sockets (13) and then run through a further upper section (10) back to the ballast in ballast enclosure (7). In Tickner, '798 twenty six W-4 pronged double inverted U-shaped lamps (22) of Sylvania designation or equal, are plugged into these sockets (13). When illuminated, there is no up light toward base end (10*a*) of fixture (10), since all of the light is directed in a downward direction by a solid opaque reflector (21) which allows no light to pass through into the upper hemisphere (10*c*) from lower hemisphere (10*b*) of lamp fixture (10).

Figure 1F:
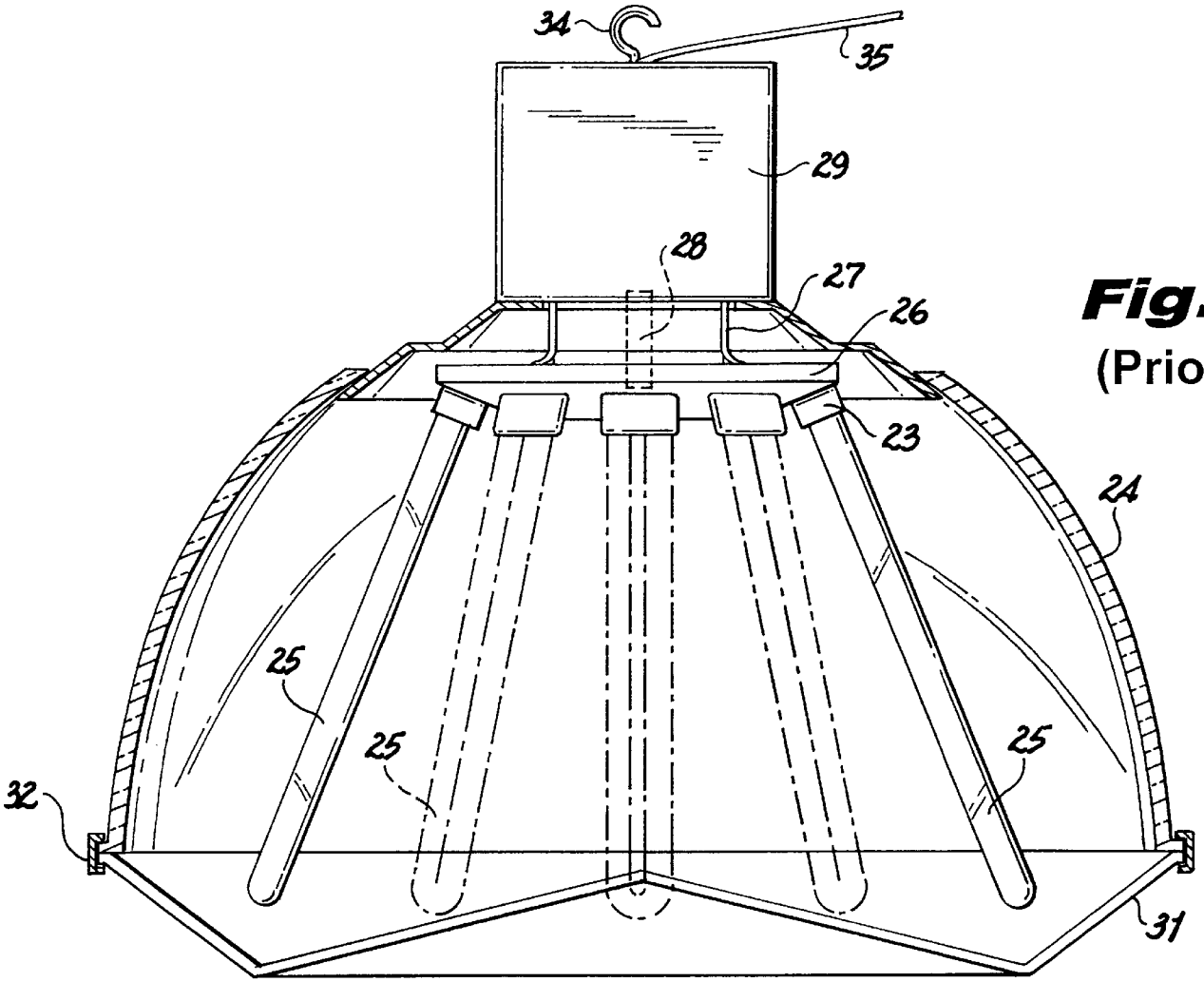
Fig. 1F (Prior Art)
FIG. 1F is a side elevational view in cross section of another compact fluorescent lamp fixture.

FIG. 1F is a diagram of a side elevational view in cross section of the prior art compact fluorescent lamp fixture described in U.S. Pat. No. 5,523,931 Kassay, Kassay & Kassay which includes a lighting fixture having a reflector/refractor (24) including a ballast compartment (29), which ballast compartment (29) is mounted directly above the fixture or remoted with a remote ballast compartment whenever the overall fixture height needs to be reduced. Enclosed in the ballast compartment (29) are sets of ballasts which power either two or three lamps per ballast. The ballasts receive their power through a cord and plug unit (35) which can have one to four circuits within it for individual control of these ballasts, with a plug to match those requirements. The lighting fixture of the prior art of Kassay et al. '931 can also be optionally directly wired with no cord end. Below the ballast compartment enclosure (29) is located a chase assembly (28) which allows for the ballast leads which power lamps (25) to be sleeved down to the sockets (23) to which they are connected.

There is also provided a plate assembly collar (27) which serves the purpose of supporting the reflector/or refractor (24), wherein the plate assembly collar (27) attached to socket mounting plate (26) is designed to receive from six to twelve "Dulux L" lamp sockets (23) as the fixture possesses a quantity of sides to match the quantity of lamps (25) desired. The standard designation of these sockets (23) are 2G11, 2G7, and GX11 of SYLVANIA® typo designation or equal configuration. Sockets (23) can be used that have an additional ability to clamp the four electrical contact pins of the "Dulux D" lamps (25) into place. This clamping mechanism secures the lamp from slipping in a downward direction. The lamp (25) can be optionally and additionally supported by a mounting bracket which mounting bracket is attached to a center axis post which runs up to the socket mounting plate.

The lamps (25) utilized in Kassay et al. '931 are referred to as Dulux L (SYLVANIA® type designated or equal) compact fluorescent lamps and these lamps come in wattages from eighteen watts to fifty five watts.

However, the fixture of Kassay '931 utilizes only lamps (25) in the thirty two watt to fifty five watt range, due to the objective of providing maximum light outputs. The lamps (25) range in length from 16.6" to 22.6" and have rated lives of 10,000 to 20,000 hours and beyond.

The light created by these lamps (25) of Kassay et al. '931 is then optically controlled by a combination of the concave reflector and/or refractor (24) and the possible optional addition of a light diffusing lens (31) held in place by a band clamp or fasteners (32).

The use of a concave translucent refractor/reflector (24) Kassay et al. '931 allows for the beneficial results of providing up light capabilities toward the ceiling, by allowing a preset quantity of uptight, from 0 to 80 percent of total light generated. This uptight capability allows for a very even distribution of light through reflectance, as shown by supporting test data of Luminaire Testing Laboratory, 905 Harrison Street, Allentown, Pa. 18103, report #01481 on the nine lamp unit and a further testing comparison of Tupper Lighting Application, P.O. Box 794, Baldwinsville, N.Y. 13027 for "Interior Lighting Point by Point" calculations, which utilizes the Luminaire Testing Laboratories finding to calculate projected installation light levels. It is noted that these tests are based on a nine "Dulux L" lamp fixture with three energy efficient electronic ballast fixtures with three lamps per electronic ballast. The lamps used are FT39DL/841 (Sylvania) rated at 2900 lumens each.

The draw back of Kassay et al. '931 is that when utilized in an installation with a dark ceiling the uptight generated is lost.

Figure 2:
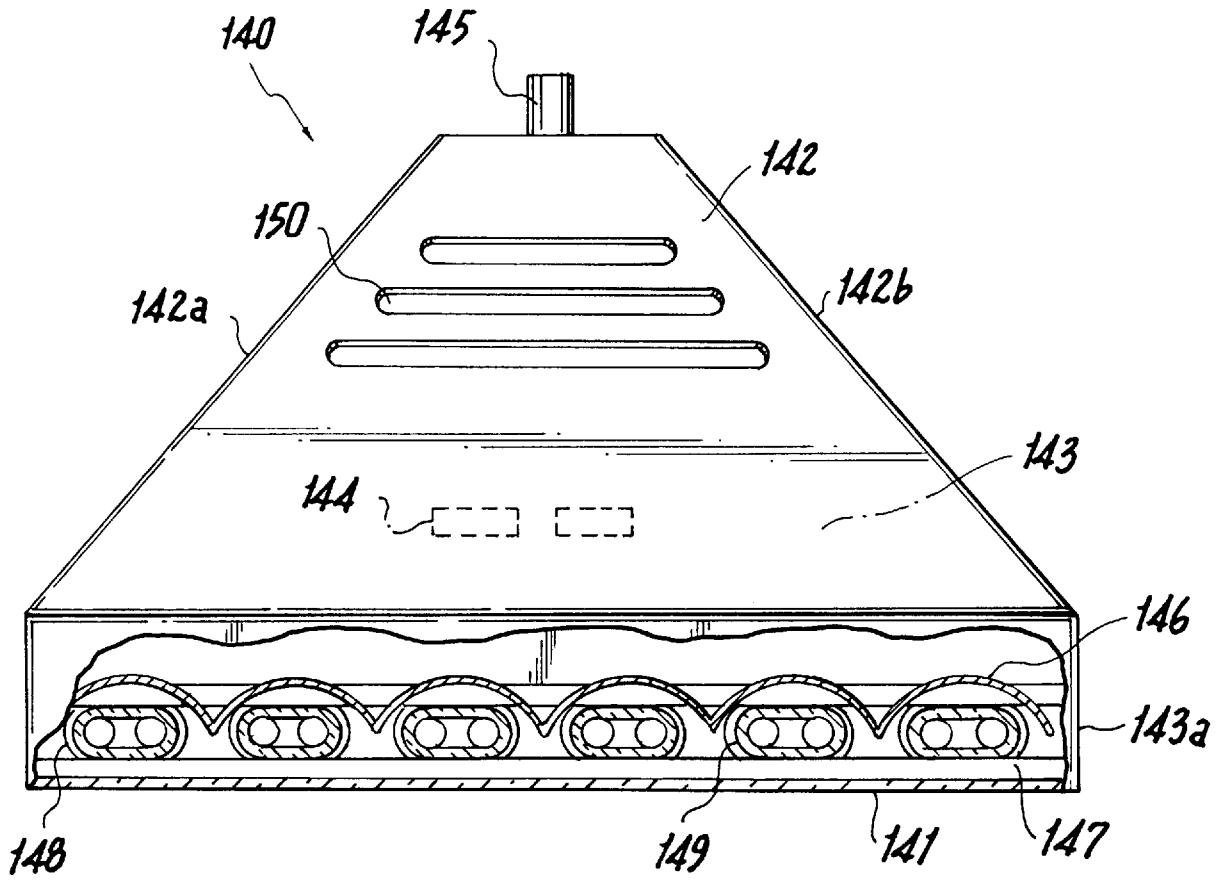
FIG. 2 is a side elevational view in partial cross section of the high lumen output fluorescent lamp fixture of the present invention.

In contrast to the prior art light devices, the present invention is described in FIG. 2, which shows a cross sectional view of the new design of the present invention, which includes a lighting fixture (140) having a lens (141) and housing (142). Housing (142) bears a special configuration of a tapered, truncated four sided pyramid to maximize stability of the position of the fixture (140) which is suspended and is pendant hung from a ceiling.

Figure 3:
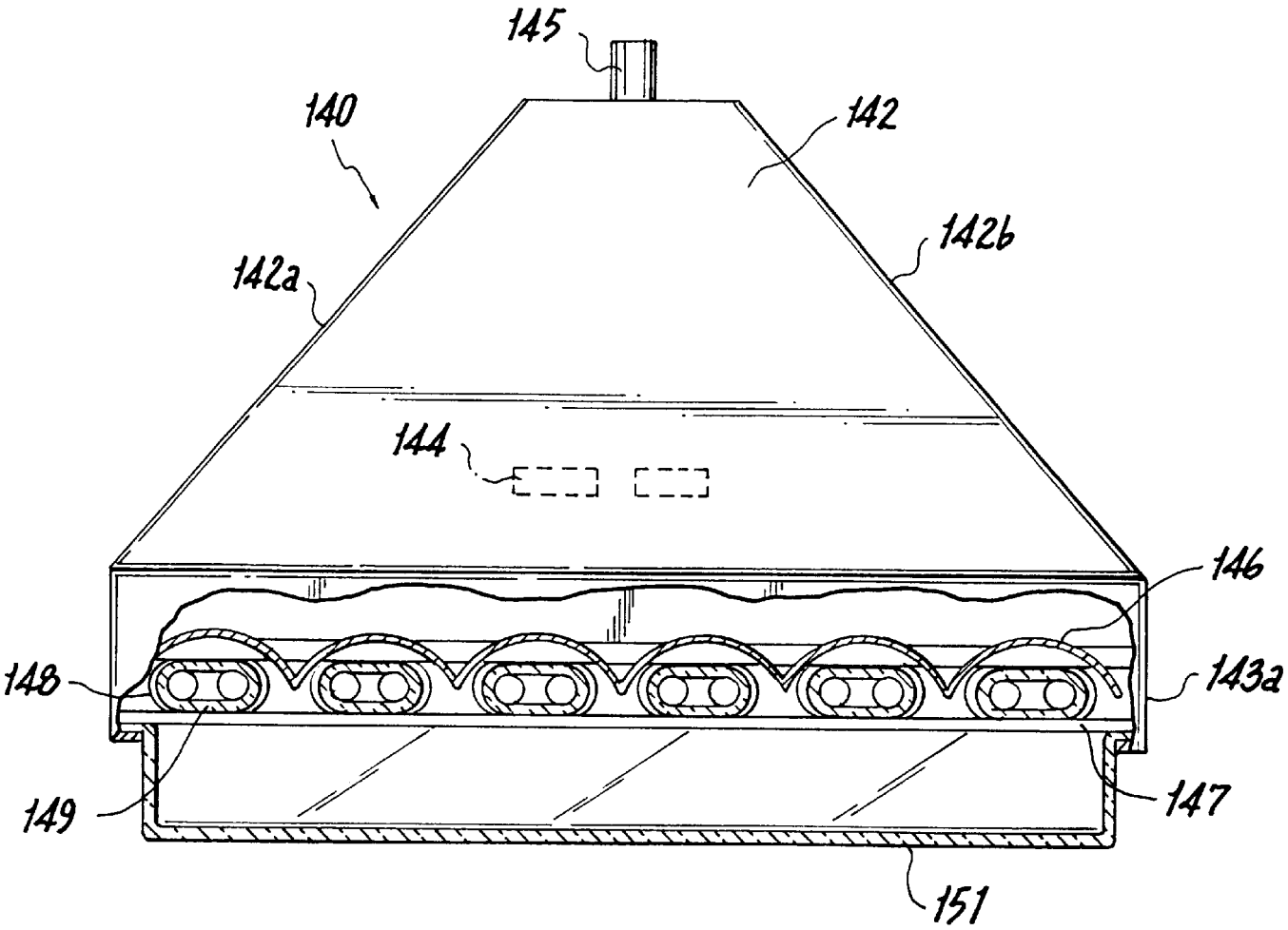
FIG. 3 is a side elevational view in partial cross section of another embodiment of the high lumen output fluorescent lamp fixture of the present invention.
Figure 4:
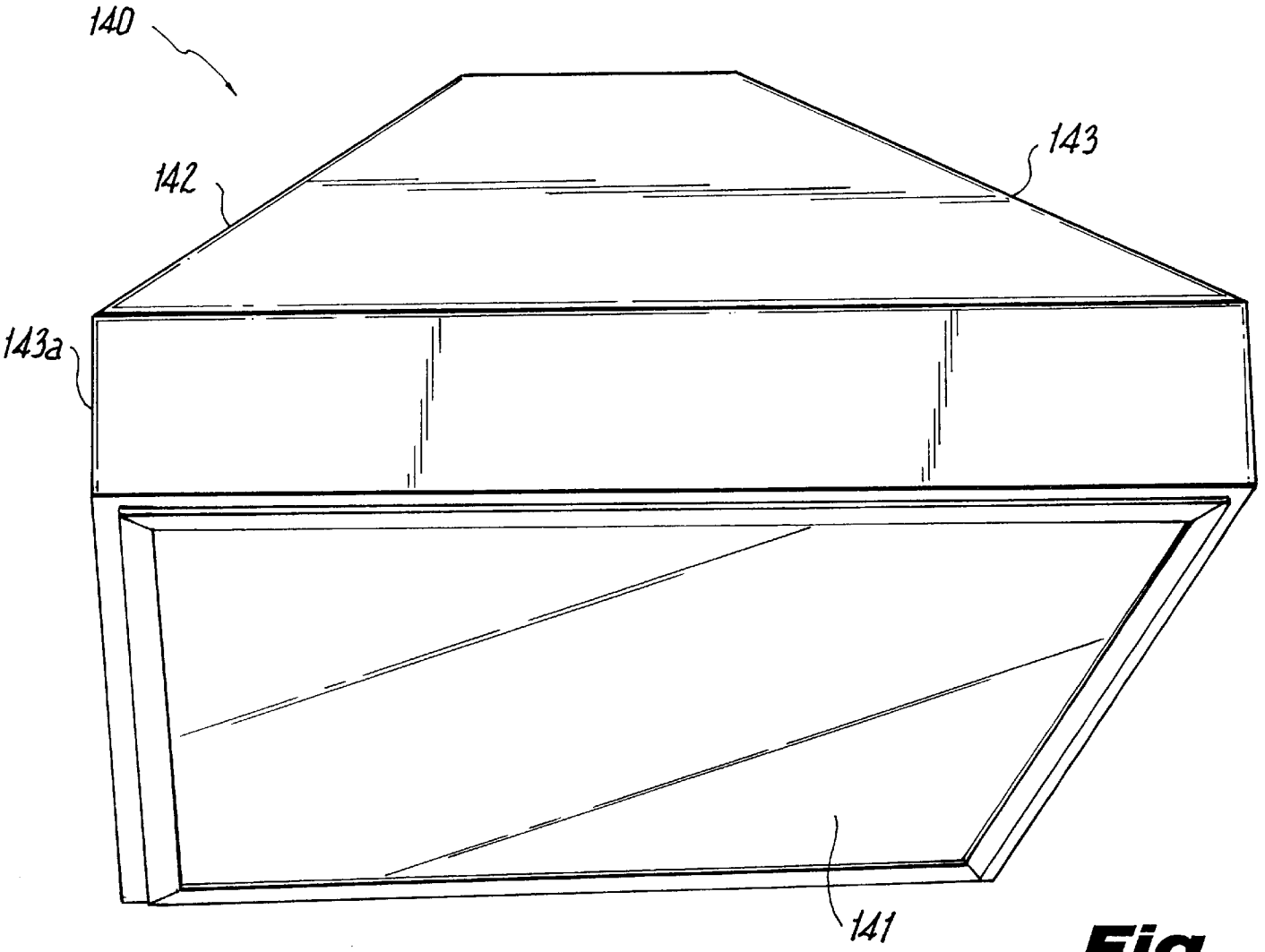
FIG. 4 is a bottom perspective view of the embodiment of the present invention, shown in FIG. 1.
Figure 5:
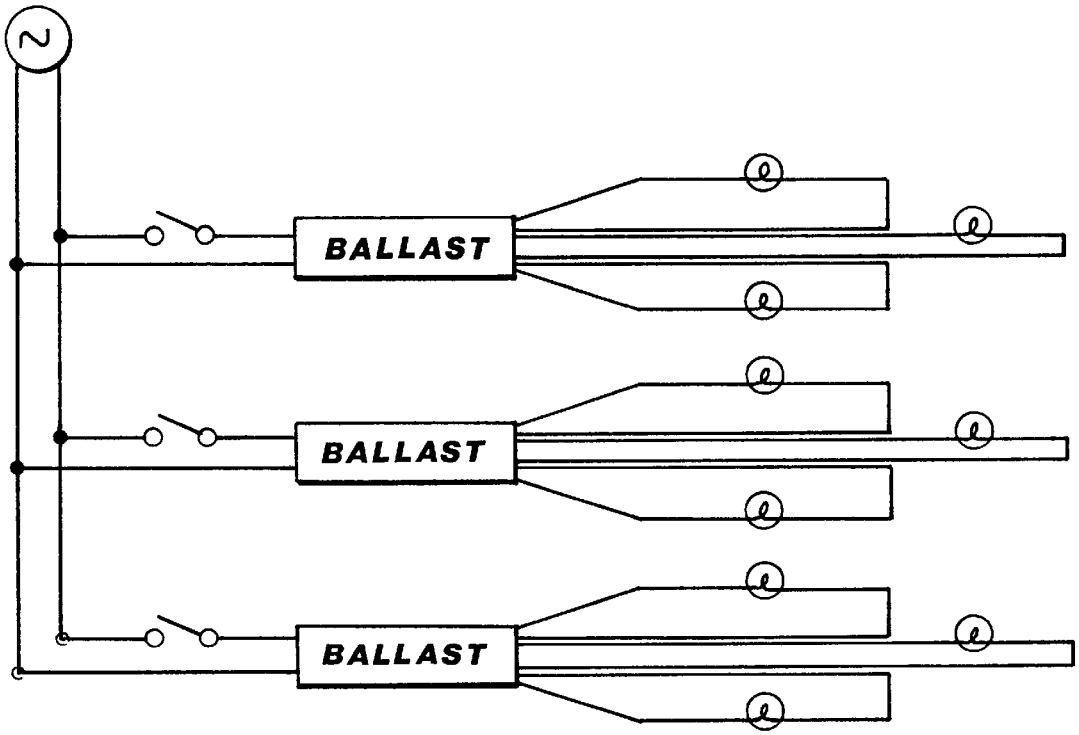
FIG. 5 is a wiring diagram of a plurality of high lumen output fluorescent lamp fixtures of the present invention.

As shown in FIGS. 2 and 3, housing 142 of lighting fixture 140 includes a deep upper ballast compartment 143 and lower shallow lamp socket compartment 143*a*. As shown in FIG. 2, deep ballast compartment 143 may accommodate venting slots 150 to dissipate heat therethrough. Furthermore, walls 145*a*, 142*b*, extend up obliquely from socket compartment 143*a*, converging toward upper pendant mount hub 145. In addition, as shown in FIGS. 2, 3 height "HA" of ballast compartment 143 is at least twice the height "HB" of socket compartment 143.

When viewed from the bottom, into its respective light emitting end, housing (142) may be rectangular in cross section, having typical dimensions of two feet by four feet or two feet by three feet. Optionally, housing (142) may be square in cross section, having typical dimensions of two feet by two feet.

Housing (142) encloses ballast compartment (143), which ballast compartment contains single ballast (144) or multiple ballasts (144). Ballasts (144) power either one, two or three lamps per ballast. Ballasts (144) receive their power through a cord entering through hub (145), which hub (145) can have one to four circuits within it for individual control of these ballasts. Lighting fixture (140) of the present invention can also be directly wired with no cord end. Below ballast compartment (143) is a reflector (146) which is used to maximize the efficiency of compact unshaped fluorescent lamps (149) in fixture and to direct the light downward through lens (141). Reflector (146) is attached and supported by socket bar (147) to which sockets (148) are fastened. Socket bars (47) or mounting plates, which can be at one or both sides of fixture (140), are designed to receive from two to eight "Dulux L" lamp sockets (148) per socket bar (147) to match the quantity of lamps (149) desired. The standard designation of these sockets (148) are 2G11, 2G7, and GX11 of a SYLVANIA® tYPE or equal configuration.

Lamps (149) are placed parallel to each other and parallel to the plane of the light emitting end of fixture (140), so that the maximum light can be reflected down from reflector (146).

The lamps (149) utilized are referred to as Delux L (SYLVANIA® type designated or equal) compact fluorescence and come in wattages ranging from eighteen watts to fifty five watts.

Fixture (140) of the present invention utilizes only lamps, (149) in the thirty two watt to fifty five watt range, due to the objective of providing maximum light outputs. Lamps (49) range in length from 16.6" to 22.6" and have rated lives of 10,000 to 20,000 hours and beyond.

The light created by these lamp (149) is then optically controlled by a combination of the reflector (46) and the lens (41). The great advantages of the light fixture of the present invention is that it requires much less wattage than the wattage required for a prior art metal halide high intensity discharge (H.I.D.) light fixture, typically 25% to 40% less due to it's extreme efficiency. The advantages over the prior art of FIG. 1 is that due to its shape, housing (42) of fixture (140) has the ability to be pendent mounted suspended from a ceiling and to remain stable. This stability is required where the fixture might be subject to impact such as a gymnasium. Additional, a far greater amount of light is available from this design due to the heat dissipation allowed by large ballast compartment and venting slots (150) which enables fixture (140) to utilize a high number of heat producing ballasts (144) and lamps (149). Heat sync can be added to the socket mounts (147) and mounts for ballasts (144) to further dissipate heat.

This adaptability allows for the production of up to 43,200 lumens from each fixture (140) and approximately 90 lumens per watt.

The lamp ballast combinations offer an instant restart, as opposed to the extended warm up time required by conventional prior art H.I.D lamps. The color rendition of the single U-shaped "Dulux L"fluorescent lamp is also far superior to that of the H.I.D. lamps. The Dulux L lamp is also available in a far greater range of temperatures from 3000 degrees Kelvin to 6500 degrees Kelvin, thus allowing for great results in almost every application.

The advantage of the fixture (140) of the present invention over prior art of Tickner '798 is that this prior art fixture will only produce approximately 18,000 lumens.

The advantage of this fixture over the prior art of Kassay et al. '931 is that the fixture therein produces 18% up light and loses its effectiveness with a dark ceiling or deck above, because the light emitted in the upward direction is not reflected back down. The present invention produces as great an amount of lumens and directs them all in the downward direction.

There will be many variations in the construction, which should remain within the intent coverage of the present invention. Some of the variations could use different ballasts, different quantities of lamps per ballast, different quantities of lamps, changes in the reflector and/or configuration, changes in the individual lamp wattage's from 32 watt to 55 watt, use of different lens in front, such as a drop lens (151), shown in FIG. 3, remote switching by low voltage relay systems and different overall sizes to accommodate the preceding goals.

It is further noted that other modifications may be made to the present invention without departing from the scope of present invention as noted in the appended claims.

We claim:

1. A lighting fixture comprising in combination: a fixture body having a ballast compartment above a socket compartment, said ballast compartment having an upper pendant mounting end, said socket compartment having at least one reflector therein and, lens at a lower light emitting end of said socket compartment, which said reflector directs light produced through a light emitting end, of said socket compartment, said ballast compartment having a plurality of ballasts connected to a plurality of sockets mounted on a plurality of socket plates within said socket compartment, said sockets powering a plurality of compact U-shaped fluorescent lamps, each said compact U-shaped fluorescent lamp being provided with individual electrical power from each said ballast, independent from electrical power of each other said ballast, wherein the light produced by said lamps passes directly through the lens at said light emitting end or is reflected by said reflector through said lens at said light-emitting end of said lighting fixture, wherein said ballast compartment of said lighting fixture includes a shape allowing for stable pendant mounting, said shape of said ballast compartment of said lighting fixture being a truncated pyramid, open at bottom end thereof and having said suspended pendant mount at an upper end thereof, wherein a height of said ballast compartment is at least twice the height of said socket compartment.

2. The lighting fixture as in claim 1, wherein said lower light emitting end is rectangular in cross section.

3. The lighting fixture as in claim 1, wherein said lower light emitting end is square in cross section.

4. The lighting fixture as in claim 1 wherein each said U-shaped compact fluorescent lamp is laid parallel to each other of said U-shaped compact fluorescent lamps, in alternating directions, said U-shaped compact fluorescent lamps being laid parallel to the plane of said lower light emitting end of said socket compartment of said lighting fixture.

5. The lighting fixture as in claim 1 wherein said ballast compartment has obliquely extending walls extending upward and converging toward said end of said upper pendant mount ballast compartment of said lighting fixture.

6. The lighting fixture as in claim 1 wherein said compact U-shaped fluorescent lamps each have wattages of from thirty two to fifty five watts.

7. The lighting fixture as in claim 1 wherein said ballast compartment includes at least one venting slot for dissipating heat therethrough.

8. A pendant mount lighting fixture comprising a fixture body having at least one lamp socket therein, said at least one lamp socket having at least one lamp therein, said ballast compartment above a lamp socket lower compartment, said ballast compartment having at least one ballast connected to at least one lamp socket, within a socket compartment, said socket compartment having a reflector and a lens at a lower light emitting end, said ballast compartment having obliquely extending walls converging toward an upper, end, wherein a height of said ballast compartment is a at least twice the height of said socket compartment.

9. The lighting fixture as in claim 8, wherein said lower light emitting end is rectangular in cross section.

10. The lighting fixture as in claim 8 wherein said lower light emitting end is square in cross section.

11. The lighting fixture as in claim 8 wherein said at least one lamp is a plurality of U-shaped compact fluorescent lamps therein, wherein each said U-shaped compact fluorescent lamp is laid parallel to each other of said U-shaped compact fluorescent lamps, in alternating directions, said U-shaped compact fluorescent lamps being laid parallel to the plane of said lower light emitting end of said socket compartment of said lighting fixture.

12. The lighting fixture as in claim 8 wherein said U-shaped compact fluorescent lamps each have wattages of from thirty two to fifty five watts.

13. The lighting fixture as in claim 8 wherein said ballast compartment includes at least one venting slot for dissipating heat therethough.

* * * * *